United States Patent [19]

Fry

[11] Patent Number: 4,556,945

[45] Date of Patent: Dec. 3, 1985

[54] MULTI-HARNESS LOOM CONTROL

[76] Inventor: Richard B. Fry, 10 Avenue Secheron, 1202 Geneva, Switzerland

[21] Appl. No.: 500,144

[22] Filed: Jun. 1, 1983

[30] Foreign Application Priority Data

Jun. 3, 1982 [GB] United Kingdom ..... 8216158

[51] Int. Cl.[4] ..... G06F 9/06; D03D 29/00

[52] U.S. Cl. ..... 364/470; 139/29; 139/33

[58] Field of Search ..... 364/470; 139/29, 33, 139/80

[56] References Cited

U.S. PATENT DOCUMENTS

| | | | |
|---|---|---|---|
| 2,354,843 | 8/1944 | Tandler et al. | 139/455 X |
| 2,798,512 | 7/1957 | Nadeau | 139/33 |
| 2,811,175 | 10/1957 | Nadeau | 139/29 |
| 3,137,320 | 6/1964 | Parton | 139/33 |
| 3,247,815 | 4/1966 | Polevitzky | 364/470 X |
| 3,634,827 | 1/1972 | Lourie et al. | 364/470 |
| 3,844,139 | 10/1974 | De Cerjat et al. | 364/470 X |
| 4,160,467 | 7/1979 | Woodruff | 139/33 |

*Primary Examiner*—Jerry Smith
*Assistant Examiner*—John R. Lastova
*Attorney, Agent, or Firm*—Harding, Earley, Follmer & Frailey

[57] ABSTRACT

A control system for a multi-harness loom comprising drive means for each harness and electronic control means for operating the drive means to move each harness for creation of a shed pattern, the electronic control means being manually operable to sequentially operate the drive means in a predetermined manner to produce a preselected series of shed patterns.

9 Claims, 5 Drawing Figures

MULTI-HARNESS LOOM CONTROL

The present invention relates to an electronic controller for a multi-harness loom, in particular a multi-harness loom for hand weaving especially for creation of tapestry.

In hand weaving, particularly weaving of tapestry, it is desirable to be able to create as many different shed patterns in the warp sheet as possible so as to provide the weaver with a large choice of different sheds when creating artistic patterns. In a conventional hand operated loom having several harnesses, each harness is usually operated by a foot treadle. In order to produce a particular shed pattern on such a machine it is necessary to operate a special combination of treadles and after weft insertion the operator has to select a different combination of treadles.

It will be appreciated that in order to produce a particular sequence of shed patterns that the operator has to remember not only the sequence of shed patterns but the combination of treadles required for each shed pattern. This obviously places a heavy mental burden on the operator.

Additionally such operation also places a limiting factor on the number of harnesses which can be practically employed since an increase in number of harnesses (and hence associated operating treadles) results in an increase in the number of treadle combinations for different warp shed patterns. Basically for n harnesses there are $2^n$ different warp shed patterns.

It is a general aim of the present invention to provide an electronic control system, and a multi-harness weaving loom incorporating such a system, which during weaving eliminates the complexity of selecting warp shed patterns so as to enable the weaver to concentrate on the aesthetics of the weave.

The present invention also seeks to provide a control system which is simple to operate and yet enables a large number of warp shed patterns to be selected. In a preferred embodiment, operation of the control system during weaving is achieved using two switches conveniently in the form of foot pedals.

According to one aspect of the present invention there is provided a control system for a multi-harness loom comprising drive means for each harness and electronic control means for operating the drive means to move each harness for creation of a shed pattern, the electronic control means being arranged to sequentially operate the drive means in a predetermined manner to produce a preselected series of shed patterns.

According to another aspect of the present invention there is provided a loom including a control system as defined above.

Preferably the electronic control means includes computing means, such as a microprocessing unit, which is capable of storing in a memory at least one series of steps which constitute a desired weave pattern, said computing means being programmed to enable the operator to execute the or a desired series of steps in a desired manner.

Various aspects of the present invention are hereinafter described with reference to the accompanying drawings in which.

Figure 3:
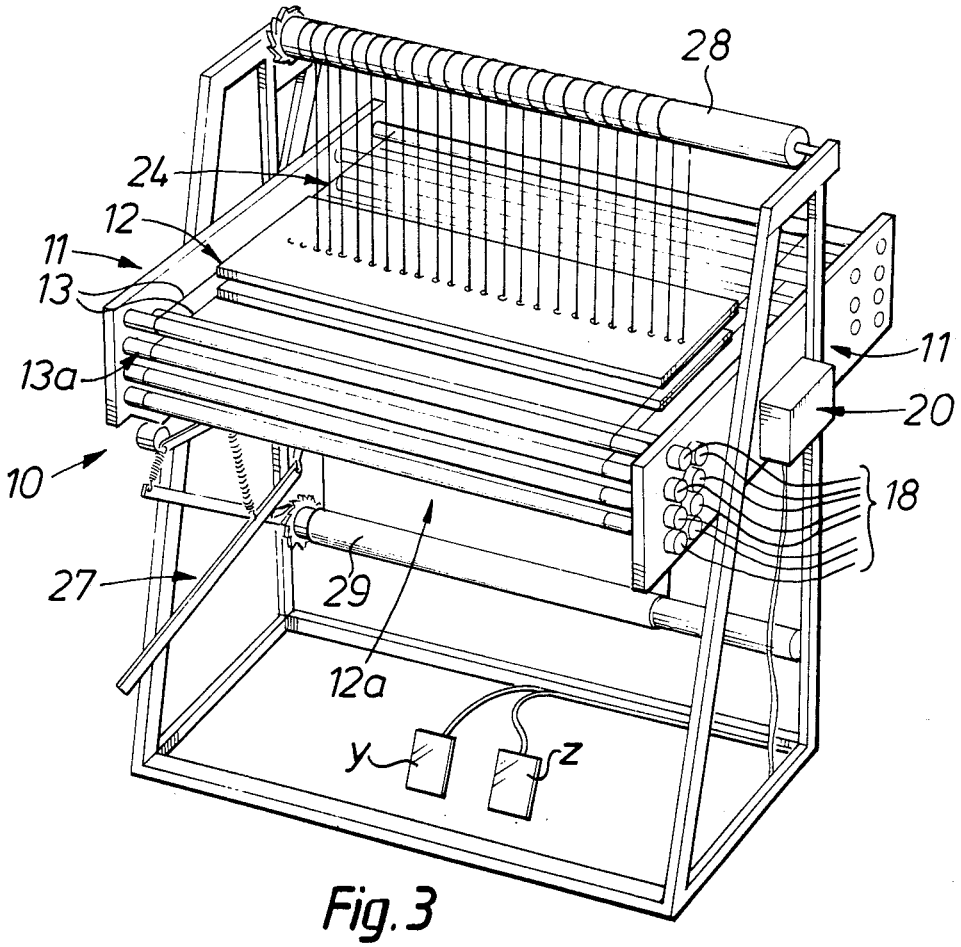
FIG. 3 is a schematic illustration of a multi-harness weaving loom according to the present invention.

Referring initially to FIG. 3 there is shown a weaving loom 10 which includes a plurality of harnesses 12 slidably mounted in the frame 11 of the loom for movement between a foremost position and a rearmost position. In the illustrated embodiment there are eight harnesses but it is to be appreciated that the number of harnesses may be more or less than eight.

Each harness 12 is moved between its foremost or rearmost position by pull cords 13 attached to rollers 13*a*, each roller 13*a* being rotated by an associated electric motor 18. An electronic control 20 is provided, which as illustrated is conveniently attached to the frame 11 of the loom and is arranged to operate the electric motors 18.

Figure 2:
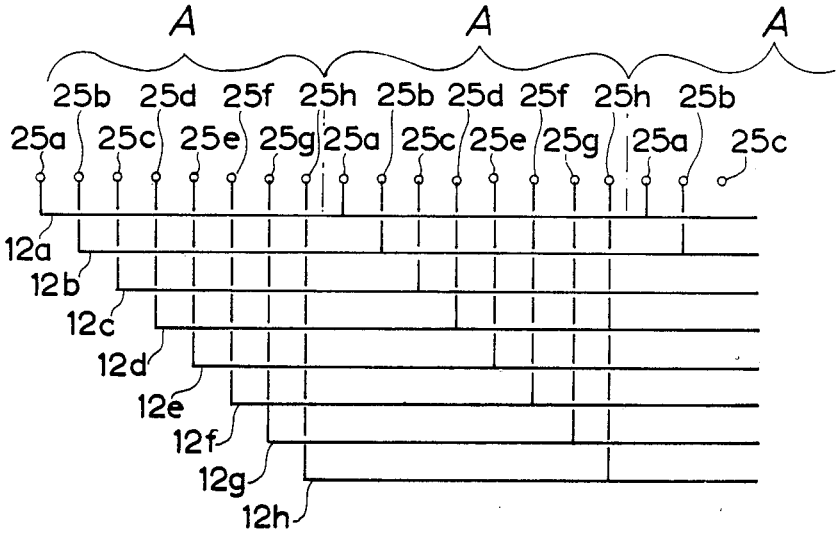
FIG. 2 is a schematic representation illustrating a possible way of threading the warp threads through the harness of the loom.

A warp sheet 24 extends from a roller 28 and through the harnesses 12 and woven fabric 12*a* is wrapped onto a bottom roller 29. Roller 29 is indexed by a lever arrangement 27, and roller 28 is held fixed during weaving. The individual warp threads are selectively threaded through the heald eyes of given harnesses so that each harness serves to move selected warp threads. Threading of the warp threads is schematically illustrated in FIG. 2 wherein the warp threads 25 are divided into groups A extending across the warp sheet, there being eight warp threads per group A i.e. the same number as the number of harnesses. The harnesses are schematically represented as horizontal lines and are referenced 12*a* to 12*h*, the vertical lines depending from each harness to a particular warp thread 25*a* to 25*h* respectively in each group indicating that that yarn alone is threaded through that particular harness.

It will be appreciated that it is possible to create different warp shed patterns by moving harnesses 12 to either their foremost or rearmost positions. For instance, if harnesses 12*a*, 12*c*, 12*e* and 12*g* are moved to their foremost position and harnesses 12*b*, 12*d*, 12*f* and 12*h* are moved to their rearmost position a standard shed pattern will be produced i.e. alternate warp threads are located on opposite sides of the shed.

With eight harnesses there are $2^8$ number of different warp shed patterns possible i.e. 256 and combining a series of these warp shed patterns together in a sequence provides a weave pattern. The electronic control includes computing means having a memory whereby before weaving the operator can enter into the memory several sequences of warp shed patterns each of which provides a different weave pattern. The electronic control is arranged so that the operator can instruct the computing means to select a given sequence of warp shed patterns and then can instruct the computing means to execute the chosen sequence of warp shed patterns in a desired manner.

In accordance with a preferred embodiment of the present invention, the computing means is arranged so that the operator is able to instruct it using a pair of foot pedals Y and Z, pedal Y being used to instruct the computing means to perform a basic function and pedal Z being used to instruct the computing means to modify the function selected using pedal Y.

By way of example the following table illustrates a selection of basic functions accessable using pedal Y and how they may be modified using pedal Z.

| Number of presses | Pedal Y | Number of presses | Pedal Z |
|---|---|---|---|
| 1 | Select a new weave | n | selects the $n^{th}$ weave |
| 2 | Begin in selected weave at a particular step in the sequence | m | selects the $m^{th}$ step |
| 3 | Execute steps in a selected sequence in ascending order | p | executes the sequence in ascending order by p number of steps |
| 4 | Execute steps in a selected sequence in descending order | q | executes the sequence in descending order by q number of steps |
| 5 | Misc. Functions | a | selects $a^{th}$ function |

Preferably a default selection is provided so that in the absence of instructions from pedal Y a particular function, such as function 3, is selected.

Figure 1:
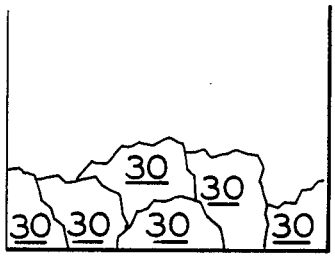
FIG. 1 is a schematic representation of fabric woven on a hand loom.

It will be appreciated therefore that the operator before weaving can concentrate on creating different weave patterns by programming different sequences of warp shed patterns into the computing means. Thereafter, on commencement of weaving the operator is freed from having to remember the combination of harness positions required for a particular shed pattern and also from the need to remember a particular sequence of shed patterns for producing a particular weave. By way of illustration FIG. 1 shows part of a woven fabric wherein discrete areas 30 are produced which are of differing weave patterns.

By way of example the control system is hereafter described by reference to FIG. 4.

Figure 4:
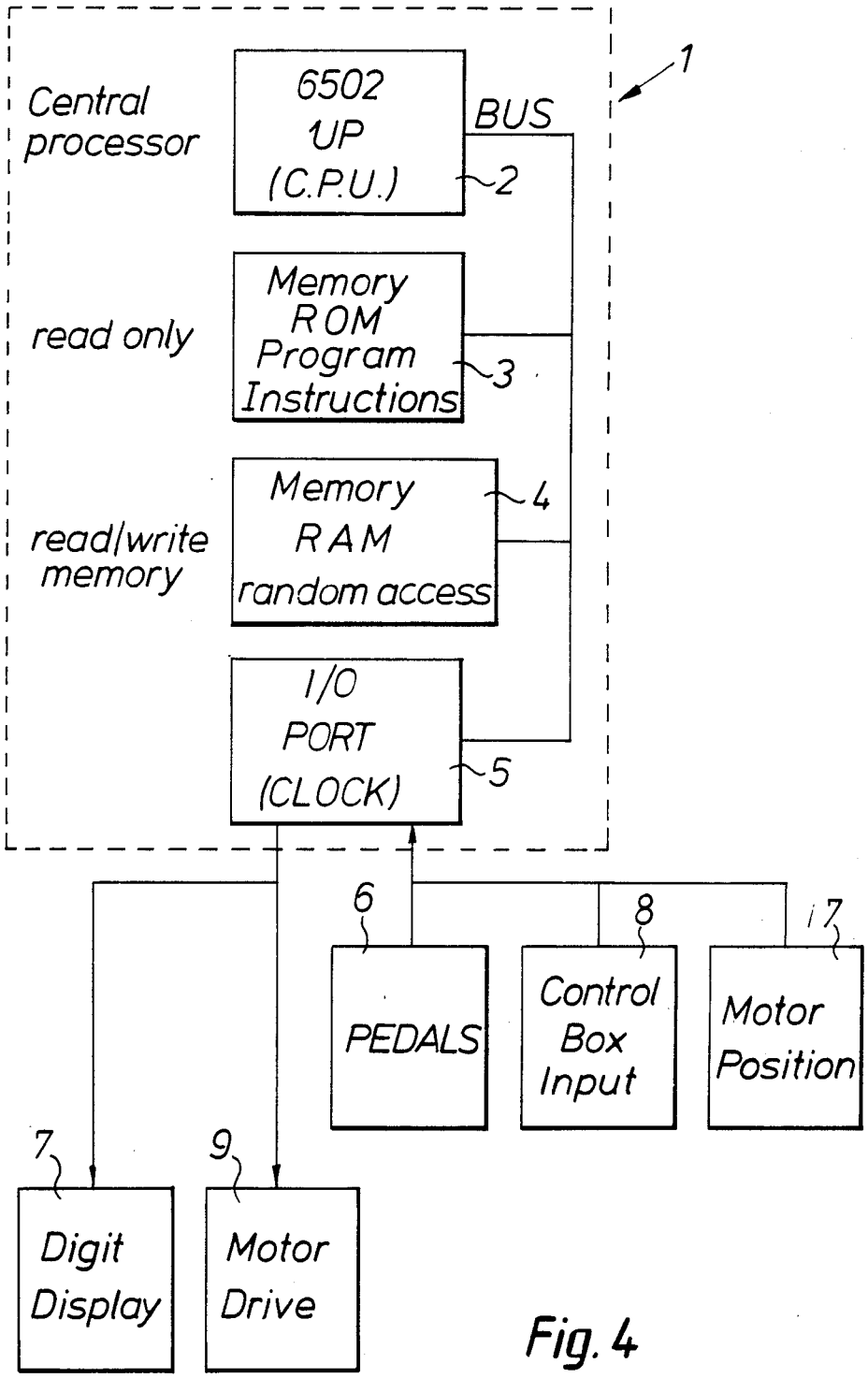
FIG. 4 is a schematic block diagram of a control system according to the present invention.

Referring to FIG. 4 the control system includes a microprocessing unit generally designated 1 which contains a central processing unit 2, a read only memory 3, a random access memory 4 and an input/output port 5.

The unit 2 may be one of the 6502 series of microprocessors although many types of microprocessor may be adapted to the present system.

The read only memory 3 contains the programme according to which the control system is run. For instance the read only memory 3 contains the programme which determines the number of times each pedal had been pressed.

The random access memory 4 is provided for storing all variables and it is here that the several sequences of shed patterns are stored by the operator prior to weaving.

An interface between the microprocessing unit 1 and all peripheral elements of the system is provided by the input/output port 5. The port 5 also contains a clock which is utilised for example to eliminate possible errors caused by 'bounce' when activating the foot pedals and which also serves to determine completion of instructions from pedal Z by disconnecting pedal Z after the elapse of a predetermined period of time following actuation of the pedal Z.

Pedals Y and Z are shown schematically at 6.

Any information which might be required by the operator is display on a digit display 7 and at the control box output. The sequences of shed patterns for creating each weave pattern are entered using a control box input 8. In order to enable the system to correctly position each harness a sensor is provided for each motor which informs the system of the motor's position. This is indicated at box 17. The motors 18 in FIG. 3 are shown at 9 in FIG. 4 and receive instructions from the port 5.

Figure 5:
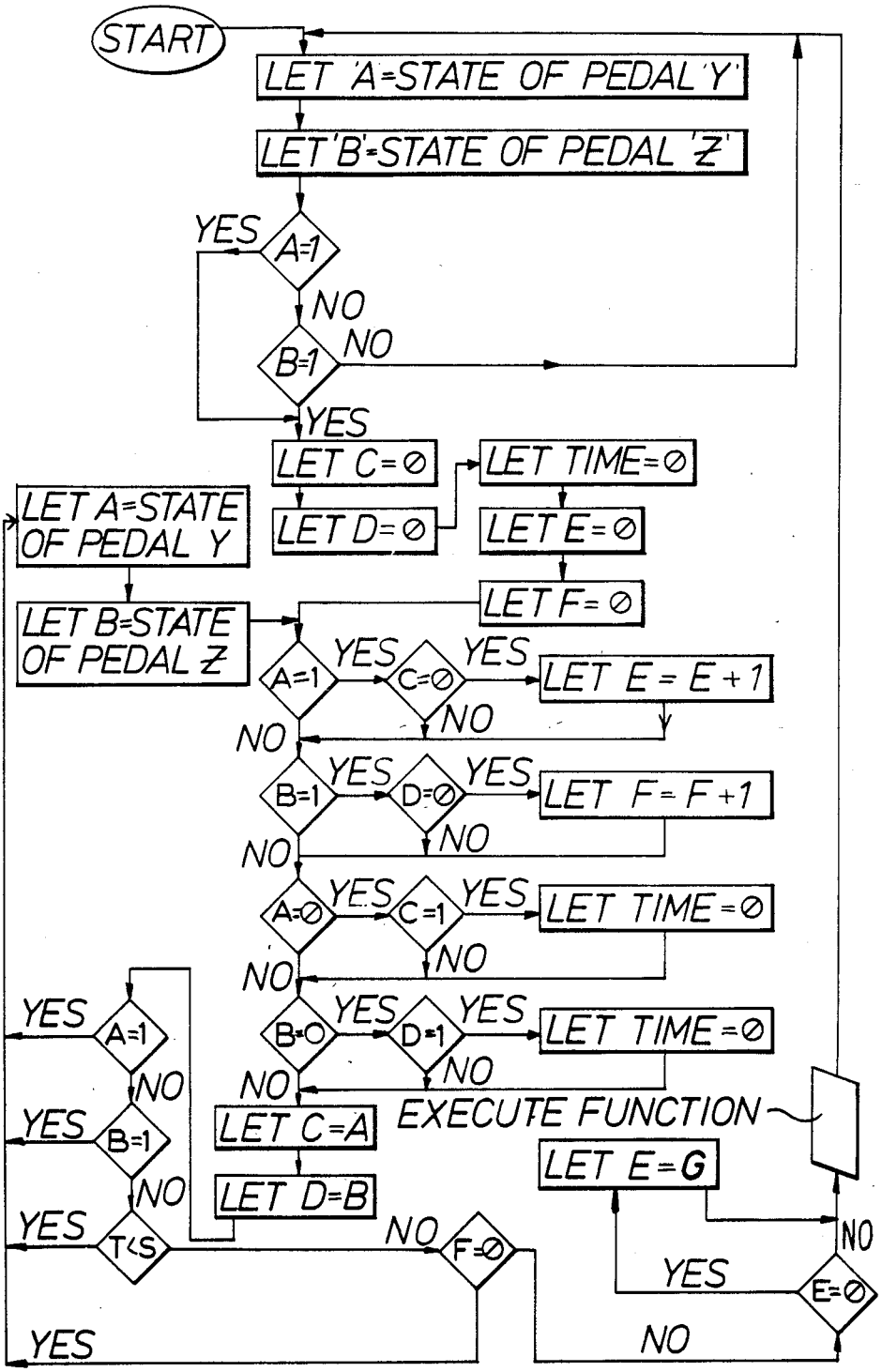
FIG. 5 is a flow diagram showing the logic of the programme used in the control system.

Referring now to FIG. 5, the way in which the computer determines the number of presses on each pedal or key is shown in the form of a flow diagram.

Variables A and B are used to store the current states of pedals Y and Z respectively. The state of each pedal may be either 0 (if the pedal is not pressed) or 1 (if the pedal is pressed).

Variables C and D are used to store the value of the immediately previous states of the pedals Y and Z respectively. Hence it is possible to compare the current states of pedals Y and Z with their immediately previous state.

Variables E and F are used to store a number corresponding to the number of times pedals Y and Z respectively have been pressed.

Variable time is used to store the time that has elapsed since pedal Y or pedal Z was last pressed. Variable S is used to store a specified time which is usually one second, the purpose of which will be explained later. Variable G is used to store a default value to which variable E is set if pedal Y is not pressed.

The speed of the system is fast enough so that no pedal can be pressed without being detected by the system. The system will continue incrementing variable E every time pedal Y is pressed and released, and variable F every time pedal Z is pressed and released unless a time greater than the specified time S has elapsed, since a pedal was last pressed. If time S has elapsed then the computer moves on to execute the steps of a weave using the values of E and F to determine the main function and instructed by pedal Y and the modification to that function as instructed by pedal Z. There is one exception to this, and that is if F=0 in which case the computer will not move on until F has a value greater than zero (that is, until pedal Z has been pressed at least once). The present system is conditioned to eliminate the artifact of 'key bounce'.

The computer will take appropriate action in all cases when the operator issues erroneous pedal presses, as for example if weave sequence number 4 is requested when only 3 weave sequences have been programmed. Or if, for example, step 7 is desired by E=2 and F=7, in a weave which contains only 6 steps.

Typical functions of what might be associated with the present system is shown in Table 1.

TABLE 1

| VALUE OF VARIABLE E | ASSOCIATED FUNCTION |
|---|---|
| 1 | Each weave (i.e. sequence of shed patterns) is allocated a number greater than zero. This function determines the last step that was executed in the weave numbered F and begins execution of weave F starting at the next step (i.e. next shed pattern) in that weave. |
| 2 | In the current weave execution is begun from the step numbered F. |
| 3 | In the current weave execution is begun from the step which is F steps forward from the last step executed. The current weave is set to "forward mode". |
| 4 | In the current weave execution is begun from the step which is F steps in reverse from the last step executed. The current weave is set to "reverse mode". |

TABLE 1-continued

| VALUE OF VARIABLE E | ASSOCIATED FUNCTION |
|---|---|
| 5 | If F = 1 then all weaves in the system are set to "forward mode". If F = 2 then all weaves in the system are set to "reverse mode". If F = 3 then all weaves in the system are set to the opposite mode of their current mode. |

If the weave is in "forward mode" then execution of that weave takes place in an ascending series of steps. If a weave is in "reverse mode" then execution of that weave takes place in a descending series of steps.

For example, for a weave of 4 steps, in "forward mode", having most recently executed step 3, a request to advance 2 steps (E=3, F=2) would result in execution of step number 1. Upon reaching an extreme or final step, the system steps to the opposite end of the series to continue steps in the same series. For the example just cited, the step beyond step 4 is step 1.

I claim:

1. A weaving control for a multi-harness loom comprising drive means for each harness and electronic control means for operating the drive means to move each harness for creation of a shed pattern from warp yarns, wherein the warp yarns of the loom are divided into a number of groups of yarns equal to the number of harnesses, each harness controls one yarn from each group and means for manually selecting a pattern from a series of predefined shed patterns as the weaving process progresses, said electronic control means being responsive to said manual selection means for controlling said drive means to implement the selected pattern.

2. A weaving control system for a multi-harness loom for weaving fabrics having artistic patterns comprising drive means for each harness and electronic control means for operating the drive means to move each harness for creation of desired shed patterns means for manually selecting a pattern from a series of predefined shed patterns as the weaving process progresses, said electronic control means being responsive to said manual selection means for controlling said drive means to implement the selected pattern.

3. A control system according to claim 2, wherein the electronic control means includes computing means for storing in a memory at least two series of predefined shed patterns, each of said series of shed patterns when performed sequentially constituting a desired weave pattern, said computing means being programmed to enable a loom operator to execute manually selected predefined shed patterns from a desired weave pattern.

4. A control system according to claim 3, wherein the computing means is programmed to enable a loom operator to manually select a desired weave pattern and to then execute manually and in a sequential manner successive predefined shed patterns in the desired weave pattern.

5. A control system according to claim 4, wherein the computing means is programmed to enable the operator to execute the successive predetermined shed patterns in either an ascending or descending order from a preselected predefined shed pattern in the desired weave pattern.

6. A control system according to claim 5, wherein the computing means is programmed to memorise the last predefined shed pattern executed in a given weave pattern, said last executed predefined shed pattern constituting said preselected predefined shed pattern when the desired weave pattern is selected.

7. A control system according to claim 6, wherein the computing means is operated via a pair of manually operable switches, one switch being used to select a desired type of command and the second switch being used to provide information to execute the command selected by the first switch.

8. A control system according to claim 7, wherein the first switch for selecting the command is operable to select a desired operational function by optionally sequencing through a series of predefined operational functions.

9. A control system according to claim 8, wherein the computing means is programmed to select a predetermined operational function as a default function.

* * * * *